United States Patent [19]

Bird

[11] 4,281,831

[45] Aug. 4, 1981

[54] PORTABLE SECTIONS FOR DOG RACE TRACK

[76] Inventor: James W. Bird, 3230 - Fifth Ave., Suite C, San Diego, Calif. 92103

[21] Appl. No.: 28,282

[22] Filed: Apr. 9, 1979

[51] Int. Cl.[3] ..... A63K 1/02

[52] U.S. Cl. ..... 272/5

[58] Field of Search ..... 272/3, 4, 5; 52/79.9, 52/64, 6, 7, 8, 9, 10; 104/130, 102

[56] References Cited

U.S. PATENT DOCUMENTS

| | | | |
|---|---|---|---|
| 2,290,242 | 7/1942 | Kasold | 52/7 X |
| 2,650,826 | 9/1953 | Alessio | 272/4 |
| 2,757,930 | 8/1956 | White et al. | 272/5 |
| 2,836,419 | 5/1958 | White et al. | 272/5 |
| 3,166,314 | 1/1965 | Weinstein | 272/5 |
| 3,897,734 | 8/1975 | Watts | 104/130 |

*Primary Examiner*—Richard C. Pinkham
*Assistant Examiner*—Arnold W. Kramer

[57] ABSTRACT

Apparatus including a pair of portable sections for use in a combined horse race track and dog race track so that in one position of the portable sections, the horse race track may be used and in another position of such sections the dog race track may be used. The invention includes power plants for selectively moving the portable sections into and out of operative position and apparatus for aligning the portable sections with the fixed sections of the dog race track when the sections are moved into operative position.

4 Claims, 7 Drawing Figures

PORTABLE SECTIONS FOR DOG RACE TRACK

BACKGROUND OF THE INVENTION

In the past both horse race tracks and dog race tracks have been in common use and usually a grandstand is located adjacent to the track for the convenience of customers. The grandstand ordinarily includes wagering booths, restaurants, and other facilities which are in use for only a few hours of a day and for a limited number of days of the year depending upon the length of the meet as governed by the racing commission of the state or other political subdivision.

In order to increase the use of the facilities, as well as to provide diversity for the racing enthusiasts, in some areas horse race tracks have been combined with dog race tracks so that dog races may be held during the period when the horses are not racing. Additionally, in some instances, a horse racing meet may be held simultaneously with a dog racing meet by holding the horse racing program in the afternoon and the dog racing program at night.

Normally a dog race track is substantially smaller than a horse race track so that the dog race track may be located within the oval of the horse race track. However, it is desirable to locate portions of both the horse track and the dog track (particularly the finish line) as close to the grandstand as possible. Accordingly, in some cases, portions of the dog track have been in overlying relationship with portions of the horse track. This has been accomplished by providing a fixed portion of a dog track within the oval or infield of the horse track and locating the home stretch portion of the dog track between the horse track and the grandstand. Since a portion of the dog track must necessarily cross the horse track, a pair of movable sections have been provided for the dog track and such movable sections may be moved into operative position when the dogs are racing and moved to inoperative position when the horses are racing.

SUMMARY OF THE INVENTION

The present invention is embodied in a pair of portable sections for a dog race track which may be moved selectively to operative and inoperative positions relative to fixed sections of the dog track by power means, as well as apparatus for automatically aligning the portable sections with the fixed sections of the dog track when the portable sections are moved into operative position. The track portions of the portable sections are spaced slightly from the track portions of the fixed sections and after the sections are in alignment, a plurality of hingedly mounted plates or bridges span the gaps between the sections and are covered by sand, silt or other natural or man-made material which forms the racing surface of the dog race track.

It is an object of the invention to provide a combined horse race track and dog race track in which the dog race track has fixed and portable sections and in which the portable sections may be moved to an operative position in overlying relationship with the horse track in a minimum of time and with minimum effort and are automatically aligned with the fixed sections when the portable sections are moved to operative position.

Another object of the invention is to provide a dog race track having fixed and portable sections which are automatically aligned by guide means when the portable sections are being moved to operative position and are locked in such position after which the gaps between the fixed and portable sections are filled so that the racing surface is continuous.

DESCRIPTION OF THE PREFERRED EMBODIMENT

Figure 1:
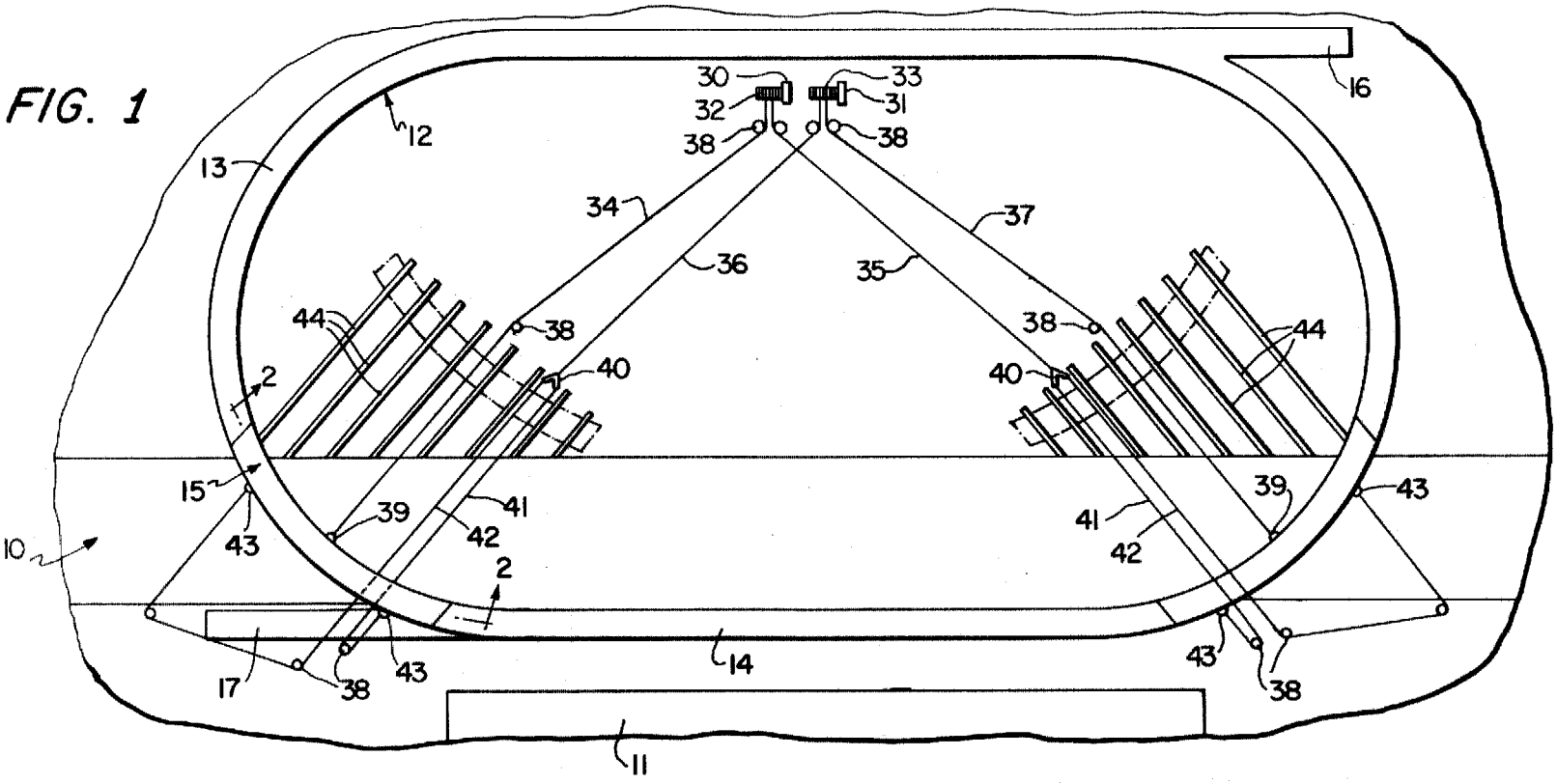
FIG. 1 is a top plan view of a combined horse race track and dog race track.

With continued reference to the drawings, a horse race track 10 is provided which may be of any conventional size such as a running distance of one mile (1609 meters) and it may be of a conventional width such as 70 feet (21.34 meters). A grandstand 11 preferably is located adjacent to a portion of the horse race track 10 and particularly in the area of the finish line so that the spectators may watch the race. Normally the horse race track 10 includes a racing surface of silt, sand or other natural or man-made granular materials which are relatively loose and friable so as to prevent damage to the legs of the horses when they run. Ordinarily the horse race track 10 is arranged in an oval and is provided with a portable starting gate so that races of varying lengths may be started at a selected point along the track with all races ending at a common finish line.

A dog race track 12 is provided and such dog race track includes a first fixed section 13 which is located entirely within the infield or oval of the horse race track. A second fixed section 14 of the dog track is located between the horse track 10 and the grandstand 11 so that the finish line of the dog race track is located adjacent to the grandstand. A pair of portable sections 15 selectively connect the first and second fixed sections to complete an oval race track when the portable sections are in alignment with the fixed sections.

Although the dog race track 12 may be of any desired size, dimensions which have been found satisfactory include a track which is 18 feet (5.49 meters) wide and formed in a loop or oval having a running distance of approximately ¼ mile (402.34 meters). Such loop includes a pair of generally parallel straightaways which measure approximately 285 feet (86.87 meters) in length and which are connected by curved portions having a radius of approximately 117 feet 5 inches (35.66 meters). With these dimensions the inner rail is approximately 520 feet (158.50 meters) long at the longitudinal center line and the straightaways are approximately 235 feet (71.63 meters) apart.

In order to accommodate dog races of varying lengths, the first fixed section 13 may have an extension 16 along the backstretch and a portable starting gate (not shown) may be located on such extension for the start of a race of 3/16 mile (301.75 meters) distance with the finish line being located generally centrally of the second fixed section 14 in front of the grandstand. The second fixed section 14 may have an extension 17 for starting a race of approximately 5/16 mile (509.92 meters) distance in which the dogs pass the grandstand and then circle the track and return to the finish line in front of the grandstand. Races of other distances, such as ⅜ mile (603.50 meters) may be started at desired locations along the track, either along one of the straightaways or along one of the curved portions.

It is necessary to move the portable sections 15 away from the fixed sections 13 and 14 of the dog race track 12 to permit the horse race track 10 to be used. Therefore, each of such portable sections is provided with an undercarriage 18 having a plurality of frames 19 connected together by longitudinal stringers 20. A platform 21 is mounted on the undercarriage 18 and such platform includes a barrier or upstanding flange 22 along the inner and outer edges for retaining a racing surface 23 of silt, sand or other granular material thereon. The racing surface covers the platform 21 to a desired depth, such as 6 inches (152.4 mm) with the exception that the ends of the portable sections, as well as the ends of the first and second fixed sections, normally are bare when the portable sections are to be moved. As illustrated best in FIG. 2, the ends of the portable sections are spaced a short distance from the fixed sections when the portable sections are in operative position, and in order to bridge the gap between the portable and fixed sections, one or more plates 24 are mounted by hinges 25 on the platform 21 at each end of the portable sections and such plates may be selectively closed to bridge the gaps. After the plates have been lowered, the space above the plates is filled with silt, sand or other granular material to the level of the racing surface on the remainder of the track to provide a continuous racing surface.

Figure 2:
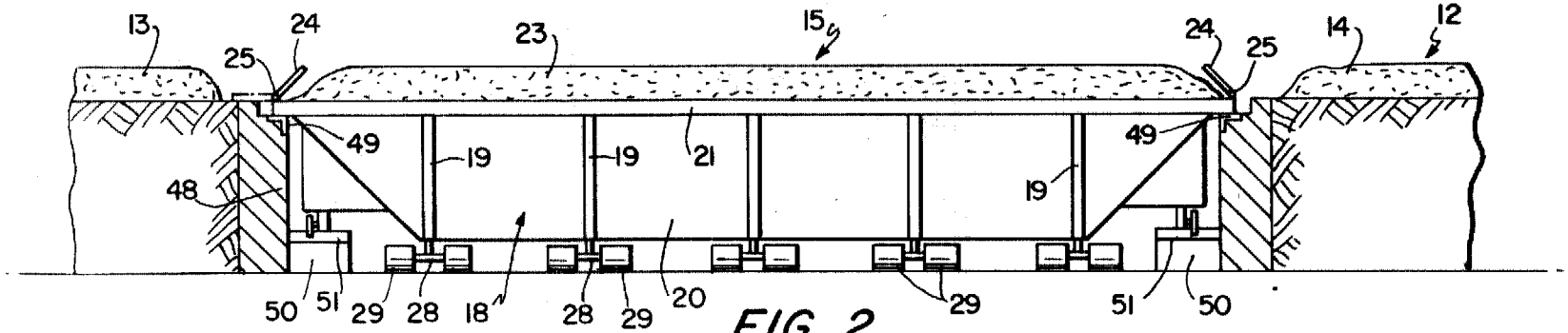
FIG. 2 is an enlarged sectional view taken on the line 2—2 of FIG. 1.
Figure 3:
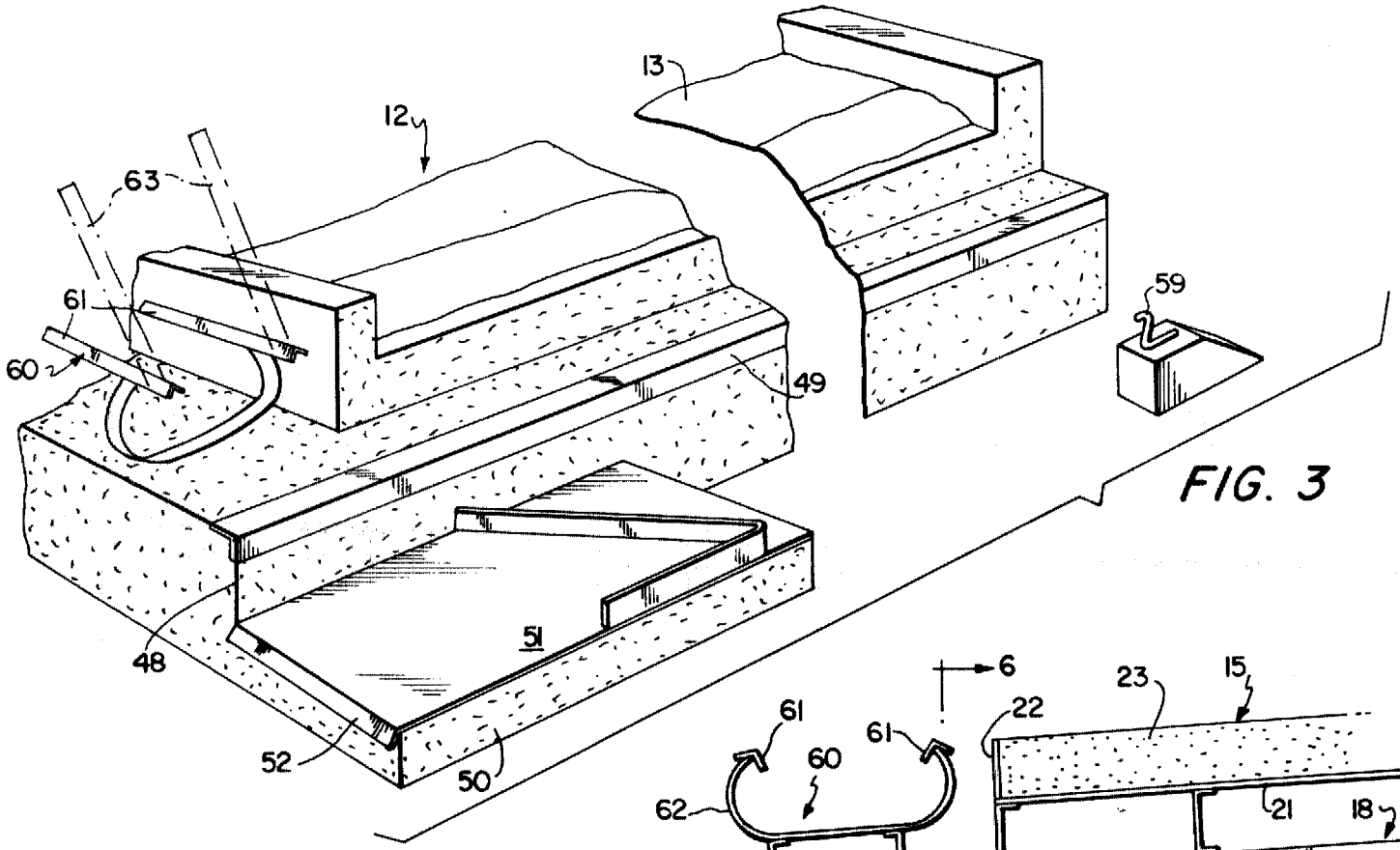
FIG. 3 is an enlarged fragmentary perspective view illustrating one end of the fixed section of the dog track.
Figure 4:
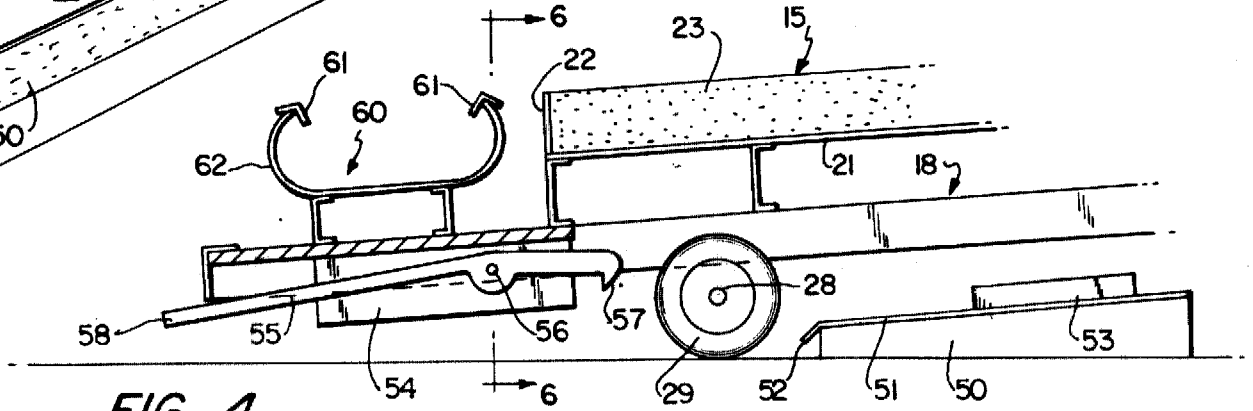
FIG. 4 is an enlarged fragmentary sectional view of a portion of the portable section.
Figure 5:
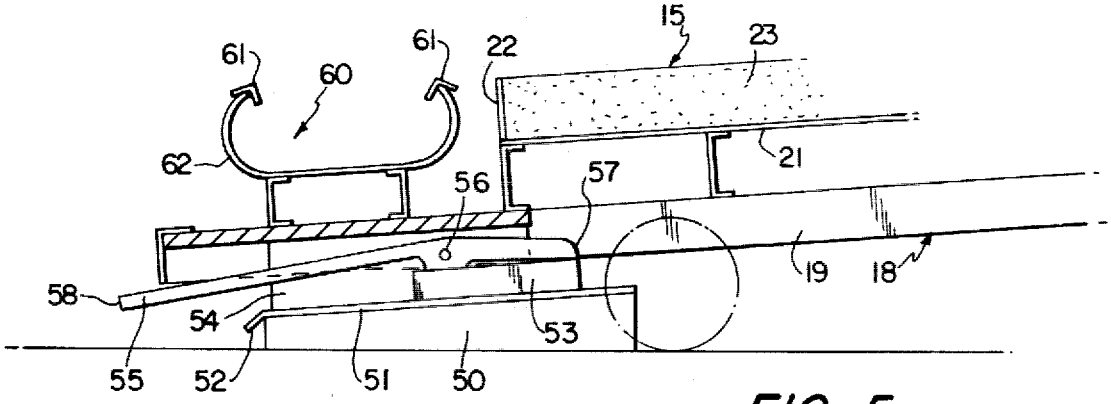
FIG. 5 is a sectional view similar to FIG. 4 and illustrating the portable section in operative position relative to the fixed section.
Figure 7:
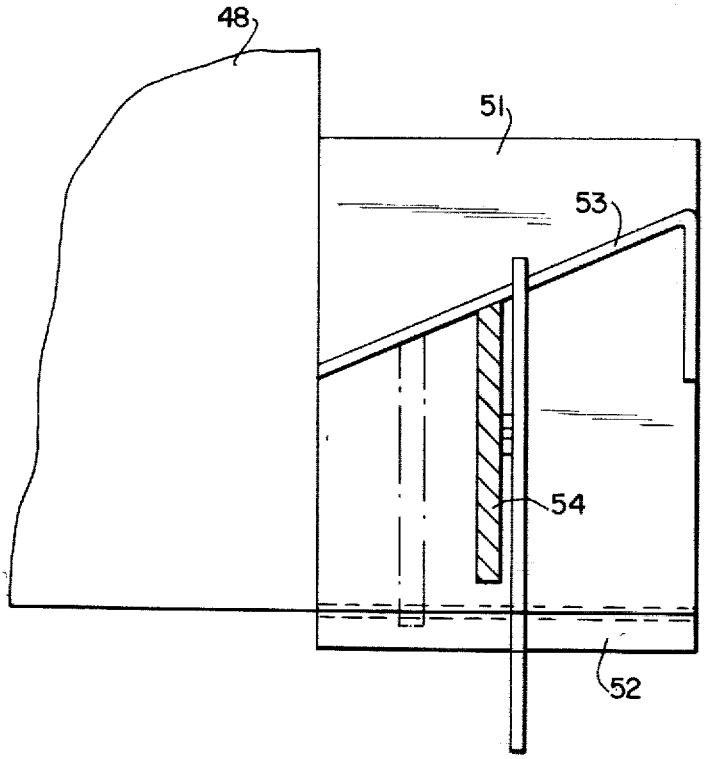
FIG. 7 is an enlarged fragmentary top view of the locking members of FIG. 5.
Figure 6:
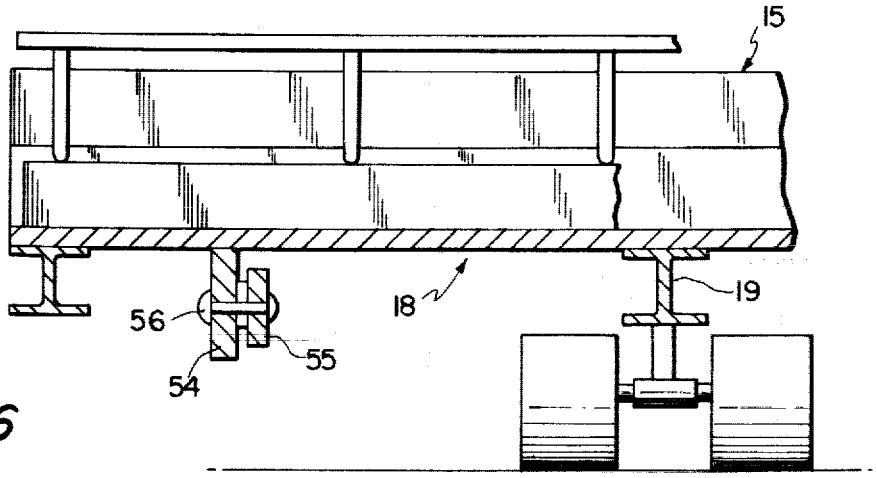
FIG. 6 is an enlarged fragmentary sectional view taken on the line 6—6 of FIG. 4.

In order to support the portable sections 15 in a manner to move such sections at least partially across the granular racing surface of the horse track, each of the frames 19 is provided with one or more laterally extending axles 28 and each of such axles rotatably engages a pair of wide tread rollers or wheels 29. Although FIG. 2 shows that one axle is located on each of the frames, it is noted that a plurality of axles and associated wheels may be disposed along the length of each of the frames to more evenly distribute the weight of the portable sections 15.

The portable sections may be moved either into the infield of the horse race track 10 or outwardly into alignment with the first and second fixed sections 13 and 14 of the dog race track 12. To accomplish this, a pair of reversible power plants 30 and 31 are provided which are operated simultaneously in the same direction, and such power plants include winches 32 and 33, respectively. A pair of cables 34 and 35 are coiled about the winch 30 and a pair of cables 36 and 37 are coiled about the winch 31. Each of the cables 34, 35, 36 and 37 is guided by one or more cable blocks or idler pulleys 38 in such a manner that the ends of the cables 34 and 37 may be connected to a ring or eye 39 located generally centrally of the inner arcuate surface of the portable sections 15. The ends of the cables 35 and 36 are each connected to a cable yoke 40 and each yoke is connected to a pair of auxiliary cables 41 and 42. Each of the auxiliary cables passes under the portable sections 15 and is guided by one or more cable blocks or idler pulleys 38 to a ring or eye 43 located on the outer arcuate surfaces of the portable sections and adjacent to opposite ends thereof.

It is noted that the cable 34 and the auxiliary cables 41 and 42 shown on the left of FIG. 1 exert generally parallel pulling forces of the lefthand portable section and that the cable 37 and auxiliary cables 41 and 42 on the right side exert generally parallel pulling forces on the righthand portable section depending upon the direction of rotation of the winches 32 and 33. Also it is noted that when the winches 32 and 33 are operated in a direction to move the portable sections toward the infield, the winch 32 reels in the cable 34, while the winch 33 is paying out the cable 36 so that the portable section shown on the left is retracted in a straight path. Simultaneously when the winch 33 is reeling in the cable 37, the winch 32 is paying out the cable 35 so that the portable section shown on the right is retracted in a straight path. In other words, each of the winches 32 and 33 reels in one of the portable sections, while controlling the direction of movement of the other portable section.

After the portable sections have been moved approximately 125 feet (38.1 meters) to the fully retracted position, as shown in phantom lines in FIG. 1, the auxiliary cables 41 and 42 are removed from the idler pulleys located on the grandstand side of the horse track so that horses may be raced thereon. If desired, a plurality of elongated base members 44 may be provided in the infield to support the portable sections when such sections are in retracted position.

With particular reference to FIGS. 3–7, the dog track 12 preferably is banked slightly so that the inner rail is at a lower elevation than the outer rail. When the portable sections 15 are moved outwardly into alignment with the fixed sections 12 and 13 of the dog track, it is important that such portable sections be accurately aligned with the fixed sections. In order to do this, each of the fixed sections is provided with a concrete ledge 48 extending entirely across the end of the same and such ledge has a reinforcing metal angle 49 fixed to the edge in a position to engage the bottom of the platform 21 adjacent to the ends thereof. Below the ledge 48 a bottom platform 50 is provided adjacent to the inner rail which extends outwardly from each of the fixed sections toward the other fixed section. An inclined skid plate 51 is mounted on the upper surface of each of the platforms 50 and each of such skid plates includes a downwardly angled lip 52 on the end facing the infield. As illustrated best in FIGS. 3 and 7, an angularly disposed positioning and stop member 53 is welded or otherwise attached to the upper surface of the skid plate 51.

A metal skid or engaging member 54 is mounted at each end of each of the portable sections in positions such that when the portable sections are moved outwardly the bottom surfaces of the ends of the platform engage and slide along the reinforcing angles 49 until at least one of the skids 54 engages its associated stop member 53. If the portable section is out of longitudinal alignment with the fixed sections, the skid or engaging member 54 at one end of the portable section will engage the stop member 53 before the skid or engaging member at the other end engages its stop member. Continued outward movement of the portable section causes the engaged skid to slide along the angularly disposed stop member to move the portable section lengthwise until the skid at the opposite end engages its stop member. If desired, the bottom edges of the portable sections may be provided with rollers or other anti-friction means to facilitate both transverse and longitudinal movement of the portable sections relative to the fixed sections.

A latch 55 is connected by a pivot 56 to the skid 54 and such latch includes a hook 57 at one end and an elongated handle 58 at the opposite end. The hook includes a rounded nose which engages the stop 53 and raises the forward end of the latch 55 so that the hook passes over the stop. After the hook has passed the stop, the hook 57 of the latch swings downwardly into engagement with the stop. Even though the hook of the latch 55 engages the stop, the portable section 15 can still shift longitudinally so as to align both ends of the portable section. When the portable section is to be retracted, a downward force on the handle 58 swings the hook upwardly to a position above the stop after which the portable section is free to move toward the infield.

If desired, a fixed stop 59 may be provided adjacent to the outer rails of the fixed sections and such fixed stops are positioned to engage a portion of the undercarriage 18 when the portable section is aligned with the fixed sections. If desired the fixed stops 59 may constitute a barrier against which the wheels 29 abut when the portable sections are in position.

The dog track 12 includes a mechanical lure (not shown) which is movable along a lure track 60. Such lure track may be of any desired conventional construction and as illustrated it includes a pair of rails 61 carried by generally U-shaped supports 62. Both the fixed and movable sections of the dog track are provided with lure tracks 60 and in order to permit the portable sections to be moved a pair of bridge rails 63 are hingedly mounted on the rails 61 of the fixed sections so that such bridge rails may be swung out of engagement with the rails of the portable sections when desired.

In the operation of the apparatus, assume that the horse race track 10 has been in use and that the portable sections 15 of the dog race track are located in the infield. After the horse racing program has been completed and the next succeeding program will be dog races, the auxiliary cables 41 and 42 are extended across the horse track and around the idler pulleys 38 on the grandstand side of the horse track. The power plants 30 and 31 are operated simultaneously in a direction to reel in the cables 35 and 36 which through the auxiliary cables 41 and 42 exert a substantially equal pulling force on opposite ends of each of the portable sections in a direction to move the sections outwardly. The power plants continue to operate until the portable sections are substantially in alignment with the fixed sections and the latches 55 at opposite ends of the portable sections engage the stop members 53 to lock the portable sections in position relative to the fixed sections. Thereafter the plates 24 carried by the portable sections are swung outwardly to bridge the gap between the contiguous ends of the fixed and portable sections and a granular racing surface material is dumped on such plates and spread so that a continuous racing surface is provided. The bridge rails 63 are pivoted downwardly into alignment with the lure track rails of the portable sections to provide a continuous lure track.

After the dog racing program has been completed and the horse racing track is to be used, the portable sections 15 are retracted into the infield after which a tractor or other vehicle pulling a harrow or other earth-working implement is driven along the horse race track to loosen the granular material of the racing surface which may have been compacted by the wheels 29 of the portable sections.

I claim:

1. Apparatus for use as a race track comprising at least one fixed section having a pair of ends in spaced relationship with one another, said fixed section including a first racing surface thereon, at least one portable section having opposite ends and top and bottom surfaces, said top surface of said portable section including a second racing surface which is normally substantially aligned with said first racing surface when said fixed and portable sections are in an aligned position in end-to-end relationship, power means for moving said portable section selectively between said aligned position and a second position remote from said fixed section, a reinforced ledge means at each end of said fixed section, positioning and stop means located adjacent each end of said fixed section and extending outwardly substantially toward one another, said positioning and stop means having a generally planar bearing plate and an angularly disposed abutment means which is disposed generally diagonally across said bearing plate and at an angle to the path of movement of said portable section, skid means carried by each end of said portable section in a position to slidingly engage said abutment means as said portable section is moved toward said aligned position with said ends of said fixed section so that said portable section will be longitudinally aligned relative to said fixed section and a portion of said bottom surface of said portable section will be in engagement with each of said ledge means when each of said skid means of said portable section is in engagement with the adjacent abutment means, and means to lock each of said skid means to said abutment means when said skid means initially engages said abutment means so that when only one of said skid means initially engages one of said abutment means said portable section is moved lengthwise as said one skid means is slidably guided along said abutment means until the other skid means engages the other abutment means at which time the ends of the portable section are in alignment with the ends of said fixed section and locked thereto.

2. The invention of claim 1 in which said bearing plate is inclined so as to be upwardly disposed and extending in a direction from said second position remote from said aligned position, so as to align said portable section vertically as said skid means moves across said bearing plate from said remote position to said aligned position.

3. The structure of claim 1 in which said power means includes first and second power plants, each of said power plants having a winch, said winch of said first power plant including first cable means connected to one side of said portable section, said winch of said second power plant including second cable means connected to the other side of said portable section, whereby said first power plant moves said portable section in one direction and said second power plant moves said portable section in the opposite direction.

4. The structure of claim 1 in which said race track includes first and second fixed sections located in spaced relationship to each other and first and second portable sections which are moved simultaneously into and out of alignment with said fixed section.

* * * * *